US011567435B2

(12) United States Patent
Seshita

(10) Patent No.: US 11,567,435 B2
(45) Date of Patent: Jan. 31, 2023

(54) FIXING DEVICE INCLUDING PLURAL THERMAL EQUALIZATION PLATES AND IMAGE FORMING APPARATUS INCORPORATING SAME

(71) Applicant: Takuya Seshita, Kanagawa (JP)

(72) Inventor: Takuya Seshita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/559,230

(22) Filed: Dec. 22, 2021

(65) Prior Publication Data

US 2022/0283529 A1 Sep. 8, 2022

(30) Foreign Application Priority Data

Mar. 8, 2021 (JP) ..... JP2021-036384

(51) Int. Cl.
*G03G 15/20* (2006.01)

(52) U.S. Cl.
CPC ..... *G03G 15/2017* (2013.01); *G03G 15/2053* (2013.01)

(58) Field of Classification Search
CPC ..... G03G 15/2017; G03G 15/2046; G03G 15/2053
USPC ..... 399/33, 328, 329, 330, 334; 219/216
See application file for complete search history.

(56) References Cited

U.S. PATENT DOCUMENTS

2015/0110531 A1* 4/2015 Takagi ..... G03G 15/2053 399/329
2015/0261157 A1* 9/2015 Yamano ..... G03G 15/2053 399/329
2016/0062286 A1* 3/2016 Yoshiura ..... G03G 15/2053 399/329
2016/0378033 A1* 12/2016 Ishigaya ..... G03G 15/206 399/329
2018/0074444 A1* 3/2018 Wakatsu ..... G03G 15/2039
2018/0348676 A1* 12/2018 Kume ..... G03G 15/206
2019/0179242 A1 6/2019 Adachi et al.
2019/0196374 A1 6/2019 Adachi et al.
(Continued)

FOREIGN PATENT DOCUMENTS

JP 2012-198475 10/2012
JP 2017-167462 9/2017
JP 2017167462 A * 9/2017
(Continued)

*Primary Examiner* — Robert B Beatty
(74) *Attorney, Agent, or Firm* — Harness, Dickey & Pierce, P.L.C.

(57) ABSTRACT

A fixing device includes a rotator, a heat source to heat the rotator, a first thermal equalization plate, a second thermal equalization plate, and an overheating preventer. The first thermal equalization plate and the second equalization plate are in contact with the heat source. The overheating preventer is in contact with one end of the second thermal equalization plate in an axial direction of the rotator. The first thermal equalization plate is in contact with a portion of the heat source, and the portion of the heat source is farther from a center of the rotator than the one end of the second thermal equalization plate in the axial direction of the rotator. The first thermal equalization plate is spaced apart from the one end of the second thermal equalization plate.

11 Claims, 6 Drawing Sheets

(56) References Cited

U.S. PATENT DOCUMENTS

2021/0278790 A1 9/2021 Furuichi et al.

FOREIGN PATENT DOCUMENTS

| | | |
|---|---|---|
| JP | 2018-205404 | 12/2018 |
| JP | 2020-052345 | 4/2020 |

* cited by examiner

FIXING DEVICE INCLUDING PLURAL THERMAL EQUALIZATION PLATES AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2021-036384, filed on Mar. 8, 2021 in the Japan Patent Office, the entire disclosure of which is incorporated by reference herein.

BACKGROUND

Technical Field

Embodiments of the present disclosure generally relate to a fixing device and an image forming apparatus incorporating the fixing device.

Related Art

One type of fixing device in an image forming apparatus includes a rotator, a heat source heating the rotator, a thermal equalizer contacting the heat source to absorb an uneven heat generation distribution of the heat source, and an overheating preventer that prevents the heat source from overheating.

SUMMARY

This specification describes an improved fixing device that includes a rotator, a heat source to heat the rotator, a first thermal equalization plate, a second thermal equalization plate, and an overheating preventer. The first thermal equalization plate and the second equalization plate are in contact with the heat source. The overheating preventer is in contact with one end of the second thermal equalization plate in an axial direction of the rotator. The first thermal equalization plate is in contact with a portion of the heat source, and the portion of the heat source is farther from a center of the rotator than the one end of the second thermal equalization plate in the axial direction of the rotator. The first thermal equalization plate is spaced apart from the one end of the second thermal equalization plate.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
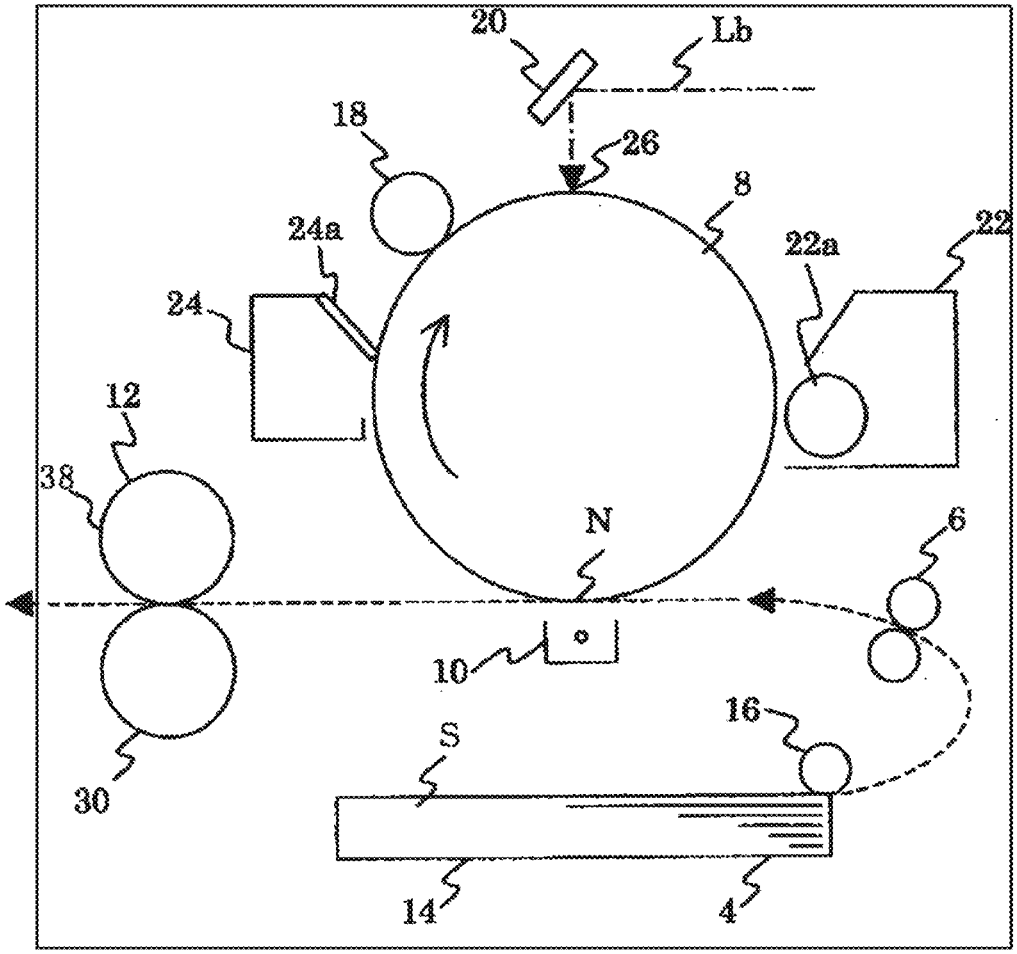
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

A description is provided of a fixing device according to an embodiment of the present disclosure and an image forming apparatus incorporating the fixing device with reference to drawings. It is to be noted that the present disclosure is not to be considered limited to the following embodiments but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

FIG. 1 is a schematic diagram illustrating a configuration of an image forming apparatus according to the present embodiment of the present disclosure.

As illustrated in FIG. 1, the image forming apparatus 2, herein serving as a printer, includes a sheet feeder 4, a registration roller pair 6, a photoconductor drum 8 serving as an image bearer, a transfer device 10, and a fixing device 12.

The sheet feeder 4 includes a sheet tray 14 and a feed roller 16. The sheet tray 14 accommodates a stack of sheets S serving as recording media. The feed roller 16 sequentially separates and feeds an uppermost sheet S from the stack of sheets P accommodated in the sheet tray 14.

The registration roller pair 6 temporarily stops the sheet S fed by the feed roller 16 and corrects the skew of the sheet S. Next, the registration roller pair 6 sends the sheet S to a transfer nip N at a timing synchronizing rotation of the photoconductor drum 8, that is, the timing at which a leading edge of a toner image formed on the photoconductor drum 8 meets a certain position of a leading edge of the sheet S in a sheet conveyance direction.

Around the photoconductor drum 8, the image forming apparatus includes a charging roller 18, a mirror 20 that is a part of an exposure device, a developing device 22 including a developing roller 22*a*, a transfer device 10, and a cleaning device 24 including a cleaning blade 24*a* in order of rotation of the photoconductor drum 8. The exposure device irradiates and scans an exposure section 26 between the charging roller 18 and the developing device 22 on the photoconductor drum 8 with a laser beam Lb via the mirror 20.

The following describes image forming operations of the image forming apparatus. After the photoconductor drum 8 starts to rotate, the charging roller 18 uniformly charges the surface of the photoconductor drum 8, and the exposure device irradiates and scans the exposure section 26 with the laser beam Lb based on image data to form a latent image corresponding to an image to be created. The rotation of the photoconductor drum 8 moves the latent image to a position facing the developing device 22. At the position, the developing device 22 supplies toner to the latent image to visualize the latent image as a toner image.

The transfer device 10 applies a transfer bias to the sheet S entering the transfer nip N at a predetermined timing to transfer the toner image formed on the photoconductor drum 8 onto the sheet S.

The sheet S to which the toner image has been transferred is conveyed toward the fixing device 12, and the fixing device 12 fixes the toner image onto the sheet S. After that, the sheet S is ejected and stacked on an output tray.

The residual toner remaining on the photoconductor drum 8 without being transferred from the photoconductor drum 8 to the sheet S at the transfer nip N reaches the cleaning device 24 as the photoconductor drum 8 rotates, and the cleaning blade 24*a* scrapes the residual toner to clean the surface of the photoconductor drum 8. After the cleaning device 24 cleans the photoconductor drum 8, a discharger discharges a residual potential on the photoconductor drum 8, and the photoconductor drum 8 is prepared for the next image forming operations.

Figure 2:
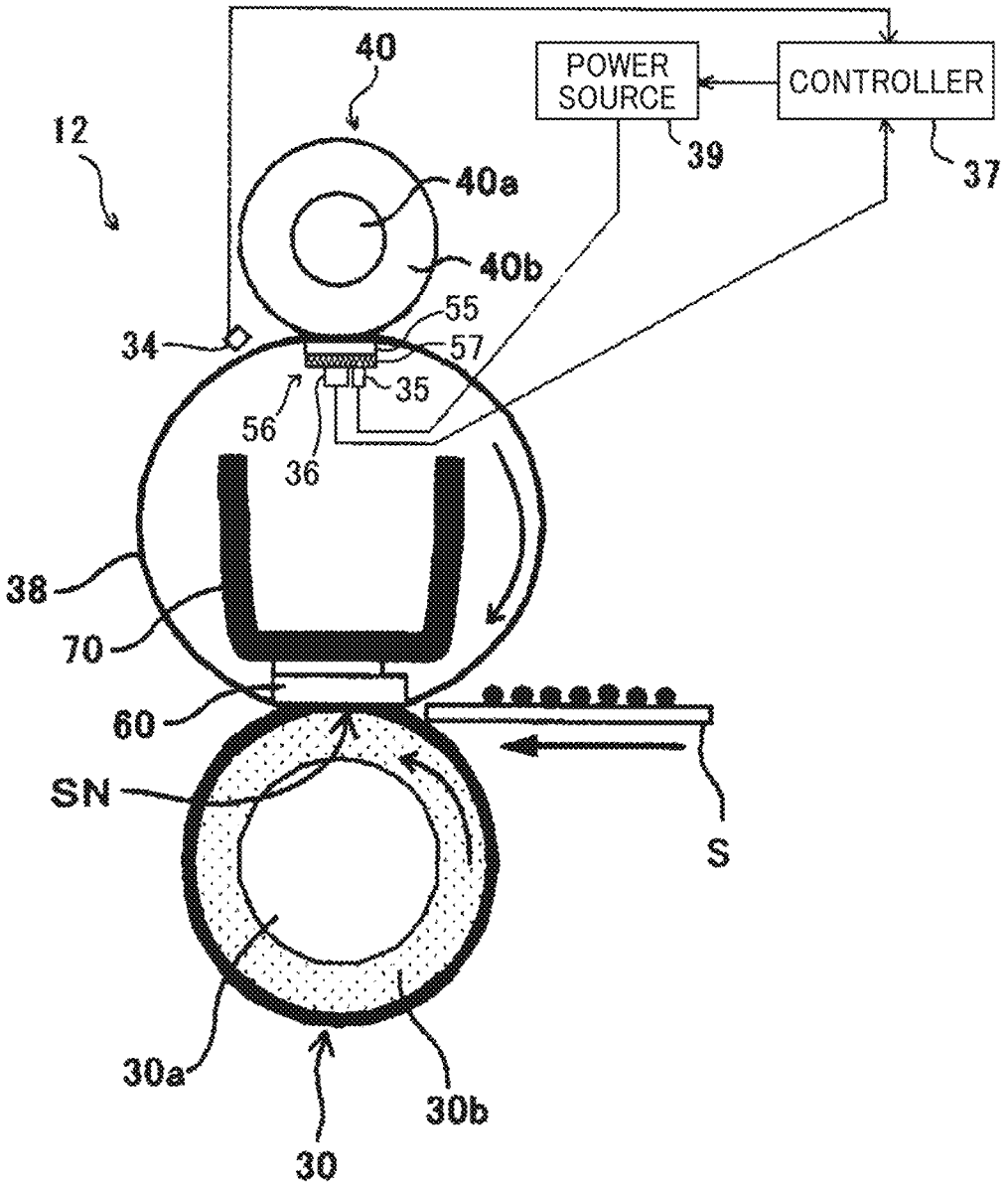
FIG. 2 is a schematic diagram illustrating a configuration of a fixing device incorporated in the image forming apparatus of FIG. 1.

FIG. 2 is a schematic diagram illustrating a configuration of the fixing device 12 incorporated in the image forming apparatus of FIG. 1.

As illustrated in FIG. 2, the fixing device 12 includes a fixing belt 38 serving as a fixing rotator and the pressure roller 30 serving as a pressure rotator pressed against the fixing rotator to form a fixing nip SN between the fixing belt 38 and the pressure roller 30. Additionally, the fixing device 12 includes a thermal equalization plate 57 as the thermal equalizer and a heater 56. The heater 56 includes a resistive heat generator 55 as a heat source to which electric power is supplied to generate heat. One or more resistive heat generators 55 and thermal equalization plates 57 are disposed so as to cover the entire image formation area in a width direction of the sheet (that is an axial direction of the fixing belt 38) orthogonal to a sheet conveyance direction of the sheet S.

Preferably, the thermal equalization plate 57 is made of a material that conducts heat quickly, for example, a material having a high thermal conductivity such as copper, aluminum, and silver. The resistive heat generators 55 may generate an uneven heat generation distribution in the width direction due to a manufacturing error or the like. The thermal equalization plate 57 transfers heat to a portion of the resistive heat generator 55 that generates a lower heat generation amount than another portion of the resistive heat generator 55 to uniform the heat generation distribution in the resistive heat generator 55.

The pressure roller 30 is a contact member that is rotatably disposed and is in contact with the outer circumferential surface of the fixing belt 38 to form a fixing nip SN between the pressure roller 30 and the fixing belt 38. In the present embodiment, a biasing member biases the pressure roller 30 toward the fixing belt 38 to press the pressure roller 30 against the fixing belt 38.

The heater 56 is supported by a support and disposed at a position in which the heater 56 contacts the inner circumferential surface of the fixing belt 38. Disposing the heater 56 in contact with the inner circumferential surface of the fixing belt 38 can prevent the heater 56 from scratching an outer circumferential surface of the fixing belt 38 that is in contact with the toner image on the sheet S and extend the life of the fixing belt 38.

In the vicinity of the heater 56, a thermistor 34 as a temperature detector that detects a surface temperature of the fixing belt 38 is disposed. In addition, an overheating preventer 35 and a thermistor 36 as a temperature detector detecting the temperature of the heater 56 are disposed on a surface of the thermal equalization plate 57 opposite to a surface of the thermal equalization plate 57 in contact with the resistive heat generator 55. In FIG. 2, for the sake of convenience, the overheating preventer 35 and the thermistor 36 are drawn at positions displaced each other in a direction of movement of the surface of the fixing belt 38 but are disposed at the center of the heater 56 in the direction of movement of the surface of the fixing belt 38, similarly to the thermistor 36.

The overheating preventer 35 operates in response to an abnormal temperature rise of the resistive heat generator 55 that is caused by, for example, breakage of the thermistor 36. When the thermistor 36 breaks, a controller 37 cannot normally control the heat generation of the resistive heat generator 55 and causes the abnormal temperature rise of the resistive heat generator 55. When the overheating preventer 35 operates, the overheating preventer 35 shuts off a current flowing to the resistive heat generator 55 to forcibly stop the heat generation in the resistive heat generator 55. Forcibly stopping the heat generation in the resistive heat generator 55 as described above prevents overheat of the resistive heat generator and thermal damage or the like of members.

As the overheating preventer 35, a thermostat, a thermal fuse, or the like may be used. The thermostat includes a bimetal that is plates made of metal or alloy and deforms at a predetermined temperature or higher to shut off the current flowing through the resistive heat generator 55.

The thermal fuse includes a fuse element connected between lead wires. The fuse element is made of a conductive resin or alloy that melts at a specified temperature. Melting the fuse element at the specified temperature or higher shuts off the current flowing between the lead wires. As a result, energization of the resistive heat generator 55 is cut off.

A power source 39 is disposed to supply electric power to the heater 56. The electric power is supplied from the power source 39 to the resistive heat generator 55 of the heater 56 via the overheating preventer 35, and the resistive heat generator 55 of the heater 56 generates heat. The controller 37 controls the power source 39 based on temperature data detected by the thermistor 34 and the thermistor 36 to supply the electric power from the power source 39 to the resistive heat generator 55 of the heater 56. The controller 37 can independently control electric power from the power source 39 to each of a plurality of resistive heat generators 55. The controller 37 is a microcomputer including a central processing unit (CPU), a read only memory (ROM), a random-access memory (RAM), an input and output (I/O) interface, and the like.

In addition to the heater 56 and the like, the following various members are disposed inside a loop of the fixing belt 38. That is, inside the loop of the fixing belt 38, the fixing device 12 includes belt supports supporting the fixing belt 38, a nip formation pad 60 to form a fixing nip SN between the pressure roller 30 and the fixing belt 38, and a stay 70 on which the nip formation pad 60 is fixed. These members are connected to and supported by side plates of the fixing device 12.

The belt supports are inserted into both ends of the fixing belt 38, respectively, in a direction (the axial direction) orthogonal to the rotation direction of the fixing belt 38 to rotatably hold both ends of the fixing belt 38.

The pressure roller 30 includes a core 30*a* made of steel and an elastic layer 30*b* covering the surface of the core 30*a*. The release layer may be formed on the surface of the elastic layer 30*b* to improve releasability.

The pressure roller 30 may be a hollow roller and include a heater such as a halogen heater inside the pressure roller 30. The elastic layer 30*b* may be made of solid rubber such as silicone rubber. Alternatively, if no heater is situated inside the pressure roller 30, the elastic layer 30*b* may be made of sponge rubber. The sponge rubber is preferable to the solid rubber because the sponge rubber has enhanced thermal insulation and so draws less heat from the fixing belt 38.

In the present embodiment, a substantially flat surface of the heater 56 is in contact with the fixing belt 38. If the heater 56 has a semi-cylindrical shape so as to extend along the inner circumferential surface of the fixing belt 38, the heater 56 may be in good contact with the inner circumferential surface of the cylindrical fixing belt 38, but a process of mounting and forming a heat generator and wiring on a curved surface with high accuracy is complicated. Accordingly, accuracy and productivity of the heater having the semi-cylindrical shape are inferior to those of a so-called "planar type" heater in which the heat generator and the wiring are formed on the same flat surface.

The heater 56 in the present embodiment is the planar type heater that is excellent in both accuracy and productivity, and the good mounting accuracy improves heating efficiency.

The fixing device 12 includes the heater 56 at a position other than the fixing nip SN of the fixing belt 38. The heater 56 in the present embodiment is on an extension line connecting the substantial center of the fixing nip SN and the substantial center line of the pressure roller 30.

Additionally, the fixing device 12 includes an elastic roller 40 as a pressing member facing the heater 56 via the fixing belt 38, and a biasing member biases the elastic roller 40 against the fixing belt 38. As a result, the elastic roller 40 presses the fixing belt 38. Since the elastic roller 40 presses the fixing belt 38, the elastic roller 40 maintains a good contact state between the fixing belt 38 and the substantial flat surface of the heater 56 even when the fixing belt 38 rotates.

The elastic roller 40 includes a core 40*a* made of steel and an elastic layer 40*b* covering the surface of the core 40*a*. The elastic layer 40*b* is made of silicone rubber. The release layer made of fluororesin or the like may be formed on the surface of the elastic layer 40*b* to improve releasability.

The pressing member facing the heater 56 via the fixing belt 38 and pressing the fixing belt 38 is not limited to the elastic roller 40. The pressing member may be a member maintaining the good contact state between the fixing belt 38 and the heater 56, such as a pressing pad. The pressing member including the elastic layer such as the elastic roller 40 or the pressing pad allows the fixing belt 38 and the heater 56 to bring in close contact with each other and stably transfer heat, but a pad made of resin may be also used as long as the pad can maintain the contact state between the fixing belt 38 and the heater 56.

Figure 3:
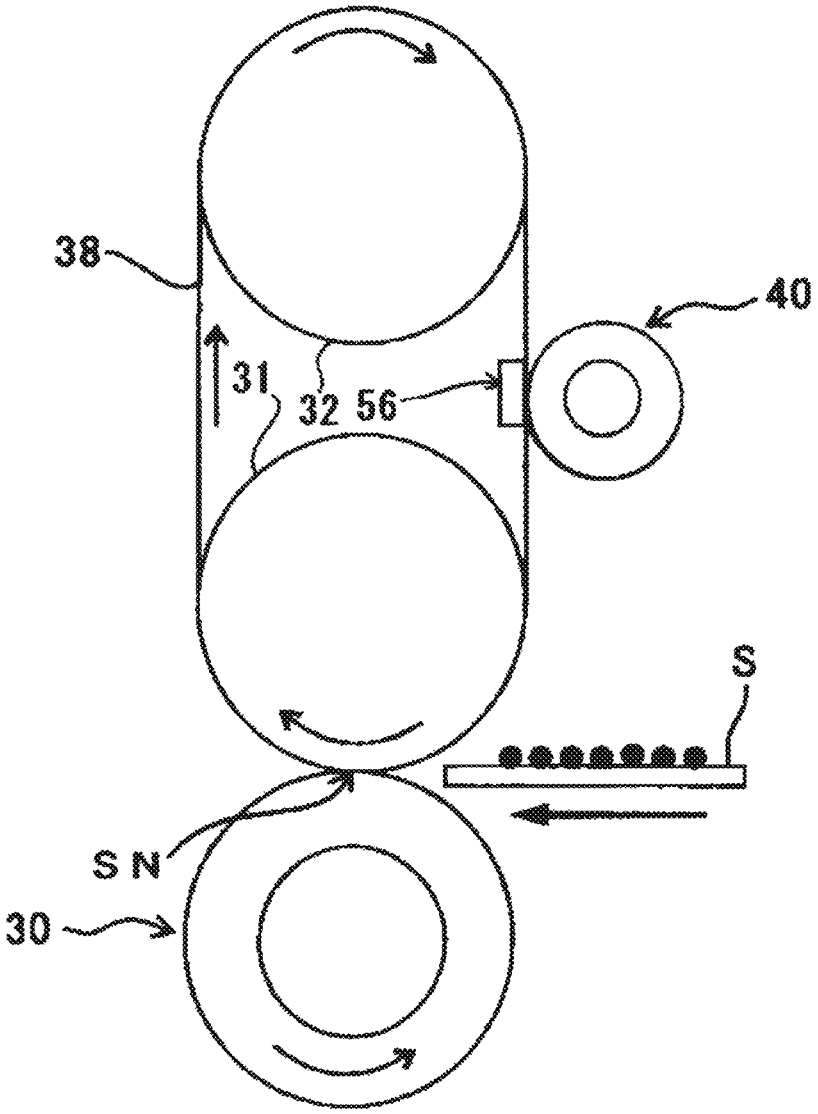
FIG. 3 is a schematic diagram illustrating a variation of the fixing device of FIG. 2.

The fixing device 12 according to the present embodiment is not limited to the configuration illustrated in FIG. 2 and may be configured as illustrated in FIG. 3.

The fixing device illustrated in FIG. 3 includes the fixing belt 38 as the rotator rotatably stretched around a first stretching roller 31 and a second stretching roller 32. The heater 56 as described above to heat the fixing belt 38 is disposed upstream from the first stretching roller 31 and downstream from the second stretching roller 32 in a rotation direction of the fixing belt 38 so as to be in contact with the inner circumferential surface of the fixing belt 38. In addition, the fixing device includes an elastic roller 40 facing the heater 56 via the fixing belt 38 and pressing the fixing belt 38 against the heater 56 to bring the fixing belt 38 and the heater 56 into contact with each other.

The first stretching roller 31 is in contact with the pressure roller 30 via the fixing belt 38 to form the fixing nip SN. The sheet S bearing the toner image is conveyed to the fixing nip SN, and heat and pressure fixes the toner image onto the sheet S.

Figure 4:
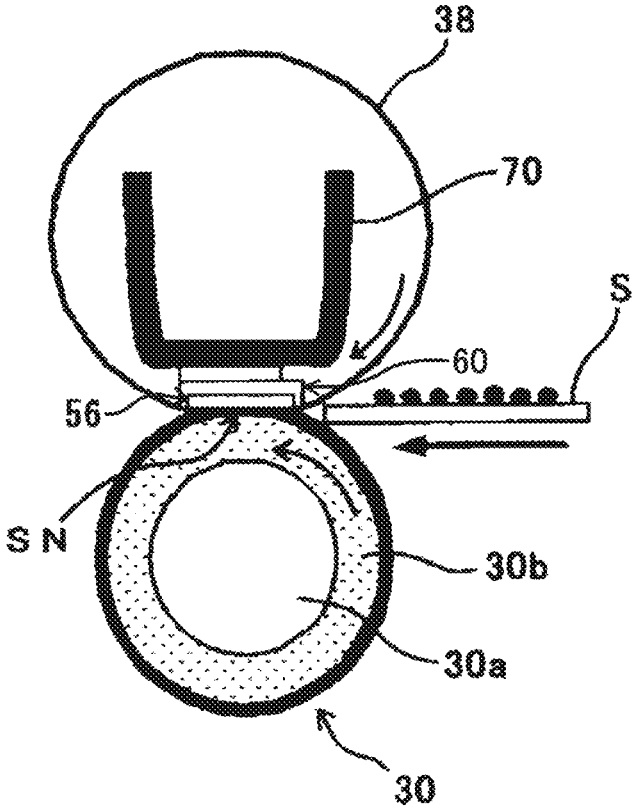
FIG. 4 is a schematic diagram illustrating an example of the fixing device including a heater in a nip formation pad.

The fixing device may be configured as illustrated in FIG. 4. In FIG. 4, the heater 56 is disposed on the nip formation pad 60. Further, instead of the heater 56 disposed inside the loop of the fixing belt 38, the fixing device illustrated in FIGS. 2 and 3 may include the heater 56 disposed outside the loop of the fixing belt 38 to heat the outer circumferential surface of the fixing belt 38.

Figure 5:
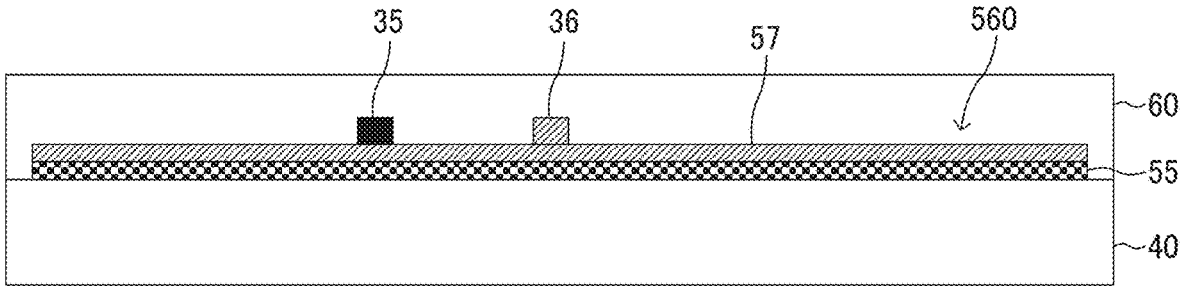
FIG. 5 is a schematic cross-sectional view of a heater according to a comparative embodiment.

FIG. 5 is a schematic cross-sectional view of a heater 560 according to a comparative embodiment.

As illustrated in FIG. 5, the length of the thermal equalization plate 57 as the thermal equalizer in the width direction of the sheet (that is the rotation axial direction of the fixing belt) is equal to the length of the resistive heat generator 55 as the heat source in the width direction. The thermistor 36 as the temperature detector is at the center of the thermal equalization plate 57 in the width direction, and the overheating preventer 35 is at a position separated from the center in the width direction.

The overheating preventer 35 and the thermistor 36 are in contact with the surface of the thermal equalization plate 57 opposite to the contact surface with the resistive heat generator 55 and detect the temperature of the resistive heat generator 55 via the thermal equalization plate 57. In the thermistor 36 that is brought into direct contact with the resistive heat generator 55, for example, the temperature detected by the thermistor 36 may reach the upper limit temperature at which the energization to the resistive heat generator 55 is turned off even when the fixing belt 38 has not reached the fixing temperature. Since the thermal equalization plate 57 has a certain degree of thermal capacity, the temperature detected by the thermistor 36 reaches the upper limit temperature at which the energization to the resistive heat generator 55 is turned off after the fixing belt 38 is sufficiently heated to the fixing temperature. Accordingly, detecting the temperature of the resistive heat generator 55 via the thermal equalization plate 57 enables satisfactorily controlling the temperature of the fixing belt 38 to be the specified temperature.

The overheating preventer 35 is generally a thermostat, a temperature fuse, or the like. After the overheating preventer 35 detects the upper limit temperature, the printer cannot be used unless the overheating preventer 35 is replaced. Since the printer cannot be used for a while after the overheating preventer 35 operates, the overheating preventer 35 is set so as to operate when the resistive heat generator 55 cannot be normally controlled, for example, when the thermistor 36 is broken.

Separating the pressure roller from the fixing belt 38 that has been in contact with the pressure roller suddenly decreases an amount of heat taken away from the resistive heat generator 55 by the fixing belt 38, and the temperature of the resistive heat generator 55 may instantaneously rise to the operating temperature of the overheating preventer 35. When the temperature of the resistive heat generator 55 instantaneously rises to the operating temperature of the overheating preventer 35 as described above, the overheating preventer 35 that brings into direct contact with the resistive heat generator 55 operates and shut off the current flowing to the resistive heat generator 55. As a result, although the heating control of the resistive heat generator 55 is normally performed, the overheating preventer 35 operates to forcibly shut off the current flowing to the resistive heat generator 55.

For this reason, the overheating preventer 35 is brought into contact with the thermal equalization plate 57. The thermal equalization plate 57 transfers heat to a portion having a low temperature to uniform the temperature distribution in the thermal equalization plate 57. The above-described function that uniforms the temperature distribution does not increase the temperature of the thermal equalization plate 57 to the operation temperature of the overheating preventer 35 even when the temperature of the resistive heat generator 55 instantaneously rises to the operating temperature of the overheating preventer 35. The above-described structure prevents the disadvantage that the overheating preventer 35 operates to forcibly shut off the current flowing to the resistive heat generator 55 although the heating control of the resistive heat generator 55 is normally performed.

However, in the comparative embodiment illustrated in FIG. 5, the overheating preventer 35 is likely to operate when small sheets continuously pass through the fixing device despite under normal heating control of the resistive heat generator 55 based on the temperature detection result of the thermistor 36.

This is because sheets do not draw heat from a non-sheet passing region of the fixing belt 38 outside a sheet passing region on which the sheets pass in the width direction of the sheet, and thus the temperature increases in the non-sheet passing region. When the temperature of the non-sheet passing region of the fixing belt 38 becomes high, the heat of the non-sheet passing region of the resistive heat generator 55 transfers to the thermal equalization plate 57 and transfers toward the center of the thermal equalization plate 57 in the axial direction to rise the temperature at a contact portion between the thermal equalization plate 57 and the overheating preventer 35. As a result, the temperature at the contact portion between the thermal equalization plate 57 and the overheating preventer 35 becomes equal to or higher than the operating temperature of the overheating preventer 35, and the overheating preventer 35 may operate to cut off the power supply to the resistive heat generator 55 although the resistive heat generator 55 is normally controlled.

In order to prevent the temperature at the contact portion between the thermal equalization plate 57 and the overheating preventer 35 from rising to the operation temperature of the overheating preventer 35, the image forming apparatus including the heater 560 in the comparative embodiment illustrated in FIG. 5 needs to limit the minimum width of sheet usable in the image forming apparatus or to reduce the productivity of printing the small sheets, hampering enhancement of usability.

Figure 6:
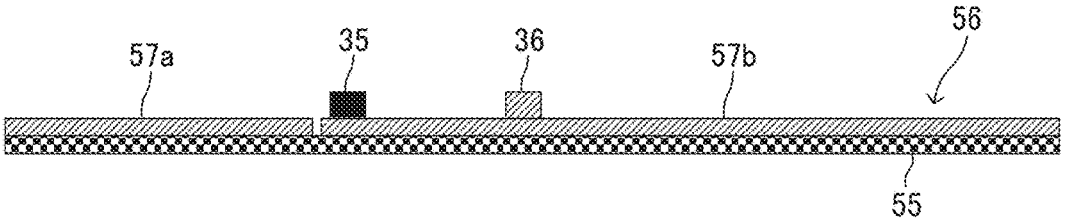
FIG. 6 is a schematic cross-sectional view of a heater of the fixing device of FIG. 2.

FIG. 6 is a schematic cross-sectional view of the heater 56 according to the present embodiment.

As illustrated in FIG. 6, the heater 56 according to the present embodiment includes a first thermal equalization plate 57*a* and a second thermal equalization plate 57*b* that are separated at a position outside the contact portion between the overheating preventer 35 and the thermal equalization plate 57*b* in the width direction.

In other words, the overheating preventer 35 is in contact with one end of the second thermal equalization plate 57*b* in the axial direction of the fixing belt 38 as the rotator. The first thermal equalization plate 57*a* is in contact with a portion of the resistive heat generator 55 as the heat source, and the portion of the resistive heat generator 55 as the heat source is farther from the center of the fixing belt 38 as the rotator than the one end of the second thermal equalization plate 57*b* in the axial direction of the fixing belt 38 as the rotator. The first thermal equalization plate 57*a* is spaced apart from the one end of the second thermal equalization plate 57*b*.

In the present embodiment, separating the thermal equalization plate into two thermal equalization plates 57*a* and 57*b* prevents heat transfer from the thermal equalization plate 57*a* to the second thermal equalization plate 57*b* in contact with the overheating preventer 35. Most of the region of the first thermal equalization plate 57*a* faces an end of the resistive heat generator 55 in the width direction that faces the non-sheet passing region in which temperature increases when the small sheets continuously pass through the fixing device. Therefore, the temperature of the first thermal equalization plate 57*a* increases when the small sheets continuously pass through the fixing device. Preventing the heat transfer from the thermal equalization plate 57*a* to the second thermal equalization plate 57*b* prevents temperature rise at the contact portion between the second thermal equalization plate 57*b* and the overheating preventer 35. Preventing the temperature rise at the contact portion prevents the temperature at the contact portion between the second thermal equalization plate 57*b* and the overheating preventer 35 from reaching to the operation temperature of the overheating preventer 35. As a result, the above-described structure can prevent the operation of the overheating preventer 35 that cuts off the electric power to the resistive heat generator 55 despite under the normal heating control. Accordingly, the image forming apparatus according to the present embodiment does not need to limit the minimum width of sheet usable in the image forming apparatus or to reduce the productivity of printing the small sheets, improving usability.

Note that each of the thermal equalization plates divided can uniform the heat generation distribution of the resistive heat generator 55.

As illustrated in FIG. 6, the thermal equalization plate is separated at a position near the contact portion between the overheating preventer 35 and the thermal equalization plate 57*b* and outside the contact portion in the width direction. In other words, the first thermal equalization plate 57*a* is spaced apart from the one end of the second thermal equalization plate 57*b* at a position adjacent to the contact portion between the overheating preventer 35 and the second thermal equalization plate 57*b*.

Separating the thermal equalization plate as described above prevents heat transfer from a portion outside from the contact portion between the overheating preventer 35 and the second thermal equalization plate 57*b* in the width direction to the contact portion. Accordingly, the above-described structure further prevents the heat of the non-sheet passing region from transferring to the contact portion between the overheating preventer 35 and the second thermal equalization plate 57*b*. As a result, the above-described structure further prevents the temperature of the contact portion between the overheating preventer 35 and the second thermal equalization plate 57*b* from rising to the operation temperature of the overheating preventer 35 or higher.

The neighborhood portion is, for example, in a range having a length in the width direction that is equal to or shorter than a width of the contact portion between the overheating preventer 35 and the second thermal equalization plate 57*b* and being from an outer end of the contact portion in the width direction. The above definition of the neighborhood portion is an example and may be narrower than the width of the contact portion or may be wider than the width of the contact portion.

Next, a description is given of variations of the heater 56.

A first variation is described below.

Figure 7:
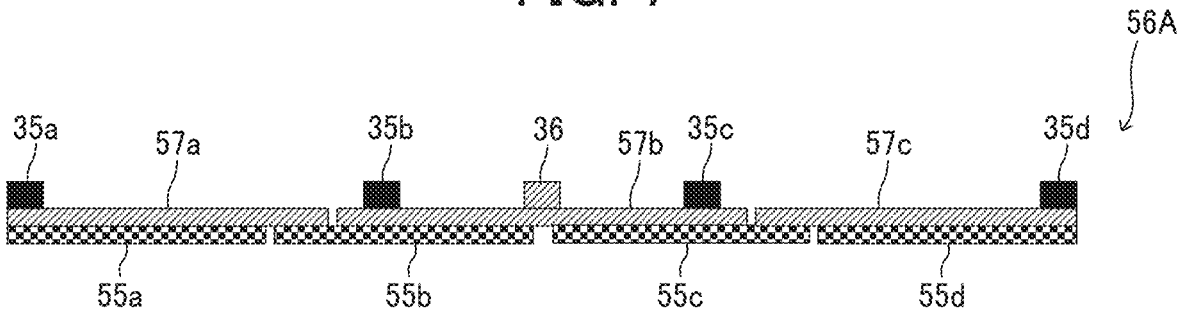
FIG. 7 is a schematic cross-sectional view of a first variation of the heater of FIG. 6.

FIG. 7 is a schematic cross-sectional view of a heater 56A that is the first variation of the heater 56.

In the heater 56A of the first variation, the resistive heat generator 55 is divided into a plurality of resistive heat generators 55*a*, 55*b*, 55*c*, and 55*d* that can independently heat the fixing belt 38.

Dividing the resistive heat generator 55 into the plurality of resistive heat generators as described above can perform a heating control in which the amount of heat generated by the resistive heat generators corresponding to the non-sheet passing region is smaller than the amount of heat generated by the resistive heat generators corresponding to the sheet passing region. The above-described structure prevents the temperature at the non-sheet passing region of the fixing belt 38 from rising too high.

The heater 56A according to the first variation includes the overheating preventer 35*a*, 35*b*, 35*c*, and 35*d* corresponding to the resistive heat generators 55*a*, 55*b*, 55*c*, and 55*d* because the resistive heat generators 55*a*, 55*b*, 55*c*, and 55*d* are independently controlled to generate heat. In response to an abnormal high temperature due to an abnormal heating control of any one of the plurality of resistive heat generators, the above-described overheating preventer corresponding to the resistive heat generator cuts off the electric power supply to the corresponding resistive heat generator under the abnormal heating control.

In the width direction, the thermal equalization plate is separated into three thermal equalization plates 57*a*, 57*b*, and 57*c* at two positions near the outer ends of two contact portions at which the thermal equalization plate 57*b* is in contact with two overheating preventers 35*b* and 35*c* nearer to the center of the fixing belt than other two overheating preventers 35*a* and 35*d*. Each of the thermal equalization plates 57*a*, 57*b*, and 57*c* is in contact with two resistive heat generators. Specifically, the first thermal equalization plate 57*a* is in contact with the first resistive heat generator 55*a* and the second resistive heat generator 55*b*, and the second thermal equalization plate 57*b* is in contact with the second resistive heat generator 55*b* and the third resistive heat generator 55*c* that are disposed near the center of the fixing belt. In addition, the third thermal equalization plate 57*c* is in contact with the third resistive heat generator 55*c* and the fourth resistive heat generator 55*d*.

The thermal equalization plate bringing into contact with the plurality of resistive heat generators as described above transfers heat between the resistive heat generators and equalizes the uneven heat generation between the resistive heat generators to uniform the heat generation distribution in the resistive heat generator.

As illustrated in FIG. 7, the resistive heat generators 55*b* and 55*c* are nearer to the center of the fixing belt than the resistive heat generators at both ends of the heater 56A and correspond to the overheating preventers 35*b* and 35*c*, respectively, and each of the overheating preventers 35*b* and 35*c* faces the center of the corresponding resistive heat generator in the width direction. As described above, disposing the overheating preventers 35*b* and 35*c* that are nearer to the center of the fixing belt than the overheating preventers at both ends of the heater 56A in the width direction so as to face the center of the corresponding resistive heat generator in the width direction and separating the thermal equalization plate at positions near the outer ends of the overheating preventers 35*b* and 35*c* in the width direction enables all the thermal equalization plate to be in contact with a plurality of resistive heat generators.

On the other hand, the overheating preventers 35*a* and 35*d* corresponding to the resistive heat generators 55*a* and 55*d* at both ends are disposed at positions corresponding to the outer ends of the resistive heat generators 55*a* and 55*d* in the width direction. Accordingly, the overheating preventers 35*a* and 35*d* come into contact with the outer ends of the thermal equalization plates 57*a* and 57*c* disposed at both ends in the width direction, respectively. Since heat transfers from outer ends of the thermal equalization plates 57*a* and 57*c* at both ends, outer ends of the resistive heat generators at both ends, and the like to other parts such as side plates, temperatures are not likely to rise at outer ends in the width direction of the thermal equalization plates 57*a* and 57*c* disposed at both ends in the width direction. Accordingly, temperatures of the overheating preventers 35*a* and 35*d* hardly reach to the operation temperature at outer ends of the thermal equalization plates 57*a* and 57*c* in the width direction that are in contact with the overheating preventers 35*a* and 35*d* under the normal heating control of the resistive heat generators 55*a* and 55*d*, respectively. The above-described structure can satisfactorily avoid the operations of the overheating preventers 35*a* and 35*d* that may cut off the power supply despite under the normal heating control of the resistive heat generators 55*a* and 55*d*.

In FIG. 7, the resistive heat generator 55 is divided into four resistive heat generators, but the number of resistive heat generators may be appropriately determined in response to the device configuration and the like. Preferably, the resistive heat generator 55 is divided so that the number of resistive heat generators is an even number. The even number of resistive heat generators corresponding to the overheating preventers 35 can be arranged symmetrically in the width direction. In the above-described arrangement, a thermal capacity of one end of the heater 56 in the width direction is the same as a thermal capacity of the other end of the heater 56 in the width direction, which enables easy heating control of each resistive heat generator.

Figure 8:
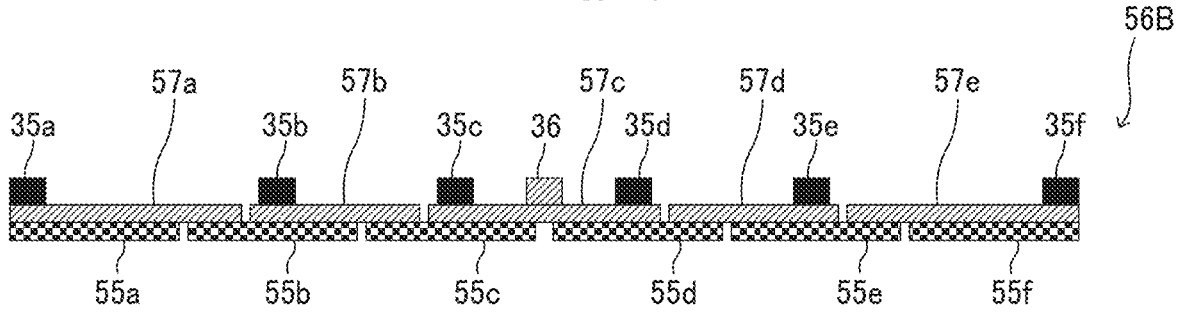
FIG. 8 is a schematic cross-sectional view of a variation of the heater of FIG. 7 including six resistive heat generators.

FIG. 8 is a schematic cross-sectional view of a heater 56B, which is a variation of the heater 56A, including the resistive heat generators 55 divided into six resistive heat generators.

In FIG. 8, the overheating preventers 35*b*, 35*c*, 35*d*, and 35*e* correspond to the four resistive heat generators 55*b*, 55*c*, 55*d*, and 55*e*, respectively that are nearer to the center of the fixing belt than the other two resistive heat generators 55*a* and 55*f*. Each of the overheating preventers 35*b*, 35*c*, 35*d*, and 35*e* faces the center of the corresponding resistive heat generator. The overheating preventers 35*a* and 35*f* correspond to the resistive heat generators 55*a* and 55*f*, respectively that are at both ends of the heater 56B in the width direction of the heater 56B. Each of the overheating preventers 35*a* and 35*f* faces an outer end of the corresponding resistive heat generator in the width direction. The thermal equalization plate is separated at four positions near the outer ends of four contact portions at which four overheating preventers 35*b*, 35*c*, 35*d*, and 35*e* nearer to the center of the fixing belt than other two overheating preventers are in contact with the thermal equalization plate. Each of the thermal equalization plates 57*a*, 57*b*, 57*c*, 57*d*, and 57*e* is in contact with the neighboring two resistive heat generators.

As illustrated in FIG. 8, the second thermal equalization plate 57*b* is configured to be in contact with the second resistive heat generator 55*b* and the third resistive heat generator 55*c*. The second resistive heat generator 55*b* corresponds to the overheating preventer 35*b* in contact with the second thermal equalization plate 57*b*, and the third resistive heat generator 55*c* is disposed nearer to the center of the heater in the width direction than the second resistive heat generator 55*b*. Accordingly, the second thermal equalization plate 57*b* can transfer heat between the two resistive heat generators in contact with the second thermal equalization plate 57*b*, that is, from the third resistive heat generator 55*c* disposed near the center in the width direction to the resistive heat generator 55*b* disposed farther from the center of the heater in the width direction. As a result, even if the second resistive heat generator 55*b* disposed farther from the center of the heater in the two resistive heat generators in contact with the second thermal equalization plate 57*b* decreases the heat generation amount, the temperature distribution of the fixing belt 38 in the width direction can be uniform between both ends of the second thermal equalization plate 57*b* in the width direction. Similarly, even if the fifth resistive heat generator 55*e* decreases the heat generation amount, the temperature distribution of the fixing belt 38 in the width direction can be uniform between both ends of the fourth thermal equalization plate 57*d* in the width direction.

When, in the width direction, the width of the sheet passing through the fixing device 12 is equal to or greater than a length from the outer end of the third resistive heat generator 55*c* to the outer end of the fourth resistive heat generator 55*d* and equal to or smaller than a length from the outer end of the second thermal equalization plate 57*b* to the outer end of the fourth thermal equalization plate 57*d*, the controller 37 may control the heater as follows. That is, the controller 37 may control the second resistive heat generator 55*b* and the fifth resistive heat generator 55*e* to generate a smaller amount of heat than an amount of heat by which one of the second resistive heat generator 55*b* and the fifth resistive heat generator 55*e* heats the fixing belt 38 to the fixing temperature. Even when the controller 37 controls the second resistive heat generator 55*b* and the fifth resistive heat generator 55*e* to generate heat as described above, heat generated by the third resistive heat generator 55*c* and the fourth resistive heat generator 55*d* allows the fixing belt 38 to reach the fixing temperature in a range from the outer end in the width direction of the second thermal equalization plate 57*b* to the outer end in the width direction of the fourth thermal equalization plate 57*d*. The above-described control can reduce the temperature rise in the non-sheet passing region and satisfactorily prevent the second overheating preventer 35*b* and the fifth overheating preventer 35*e* from operating despite under the normal heating control of the second resistive heat generator 55*b* and the fifth resistive heat generator 55*e*.

Next, a second variation is described below.

Figure 9:
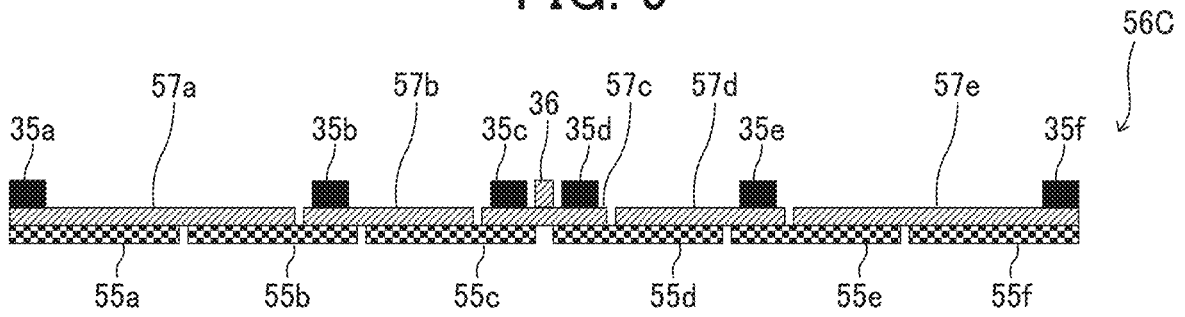
FIG. 9 is a schematic cross-sectional view of a second variation of the heater of FIG. 6.

FIG. 9 is a schematic cross-sectional view of a heater 56C that is the second variation of the heater 56.

In the second variation, the resistive heat generator 55 is divided into six heat generators. In other words, the heater 56A according to the second variation includes six resistive heat generators 55*a* to 55*f*. In addition, the heater 56A includes six overheating preventers 35*a* to 35*f* corresponding to the six resistive heat generators 55*a* to 55*f*, respectively. Each of the overheating preventers 35*b* and 35*e* that are nearer to the center of the heater 56A than other two overheating preventers 35*a* and 35*f* faces over an inner end (that is one end nearer to the center of the heater than the other end) of the corresponding resistive heat generator in the width direction.

The following advantage can be obtained by disposing the four overheating preventers 35*b*, 35*c*, 35*d*, and 35*e* near the center of the heater in the width direction at positions corresponding to the inner ends in the width direction of the corresponding resistive heat generators as described above. That is, the above-described structure can prevent the overheating preventer 35*b*, 35*c*, 35*d*, and 35*e* from being affected by the temperature rise in the non-sheet passing region when the small sheets continuously pass through the fixing device 12. As a result, the above-described structure can satisfactorily prevent the overheating preventers 35*b* to 35*e* from operating despite under the normal heating control of the resistive heat generators 55*b* to 55*e*.

In addition, the thermal equalization plate in the second variation is divided at a position in a range from the center of the resistive heat generator in the width direction to the inner end of the resistive heat generator in the width direction. In the above-described configuration, for example, the second thermal equalization plate 57*b* are in contact with two resistive heat generators 55*b* and 55*c*, and the third resistive heat generator 55*c* is nearer to the center of the heater 56C in the width direction than the second resistive heat generator 55*b*. A contact area between the second thermal equalization plate 57*b* and the third resistive heat generator 55*c* near the center of the heater 56C is larger than a contact area between the second thermal equalization plate 57*b* and the second resistive heat generator 55*b* farther from the center of the heater 56C.

Thus, the above-described configuration can more effectively utilize heat of the third resistive heat generator 55*c* near the center of the heater 56C in the width direction than the configuration illustrated in FIG. 8. As a result, even when the amount of heat generated by the second resistive heat generator 55*b* farther from the center of the heater 56C in FIG. 9 is reduced from the amount of heat generated by the second resistive heat generator 55*b* in FIG. 8, the temperature distribution in the fixing belt 38 becomes uniform in a range corresponding to the outer end of the second thermal equalization plate 57*b*. Similar to the second thermal equalization plate 57*b*, even when the amount of heat generated by the fifth resistive heat generator 55*e* farther from the center of the heater 56C in FIG. 9 is reduced from the amount of heat generated by the fifth resistive heat generator 55*e* in FIG. 8, the temperature distribution in the fixing belt 38 becomes uniform in a range to the outer end of the fourth thermal equalization plate 57*d*. As a result, the temperature rise in the non-sheet passing region in the configuration of FIG. 9 is smaller than that of FIG. 8 when sheets having the sheet width from the outer end of the second thermal equalization plate 57*b* in the width direction to the outer end of the fourth thermal equalization plate 57*d* in the width direction pass through the fixing device. Accordingly, the above-described configuration can satisfactorily prevent the second overheating preventer 35*b* and the fifth overheating preventer 35*e* from operating despite under the normal heating control of the second resistive heat generator 55*b* and the fifth resistive heat generator 55*e* that correspond to the second overheating preventer 35*b* and the fifth overheating preventer 35*e*.

The configurations according to the above-descried embodiments are not limited thereto. This disclosure can achieve the following aspects effectively.

First Aspect

In a first aspect, a fixing device such as the fixing device 12 includes a rotator such as the fixing belt 38, a heat source such as the resistive heat generator 55 to heat the fixing belt 38, an overheating preventer such as the overheating preventer 35 that are, for example, the thermostat, the thermal fuse or the like, a first thermal equalization plate such as the first thermal equalization plate 57*a* of FIGS. 6 and 7 or the third thermal equalization plate 57C of FIG. 7, and a second thermal equalization plate such as the second thermal equalization plate 57*b* of FIGS. 6 and 7. The first thermal equalization plate and the second thermal equalization plate are in contact with the heat source such as the resistive heat generator 55. The overheating preventer is in contact with one end of the second thermal equalization plate in the axial direction of the rotator such as the fixing belt 38. The first thermal equalization plate is in contact with a portion of the heat source such as the resistive heat generator 55, and the portion of the heat source is farther from the center of the rotator such as the fixing belt 38 than the one end of the second thermal equalization plate in the axial direction of the rotator such as the fixing belt 38. The first thermal equalization plate is spaced apart from the one end of the second thermal equalization plate.

The controller controls the heat source to generate heat based on the temperature detected by the temperature detector such as the thermistor that is in contact with the surface of the thermal equalization plate opposite to the surface of the thermal equalization plate in contact with the heat source. For example, separating the pressure roller from the rotator such as the fixing belt 38 that has been in contact with the pressure roller suddenly decreases the amount of heat taken away from the heat source by the fixing belt 38, and the temperature of the heat source may instantaneously rise to the operating temperature of the overheating preventer. When the temperature of the heat source instantaneously rises to the operating temperature of the overheating preventer as described above, the overheating preventer that brings into direct contact with the heat source operates and shuts off the current flowing to the heat source. The above results in the disadvantage that, although the heating control of the heat source is possible, the overheating preventer operates to forcibly shut off the current flowing to the heat source. The thermostat (a thermoswitch) used as the overheating preventer does not resume energization to the heat source unless the temperature of the overheating preventer lowers to return the deformation of the bimetal to an original state. The thermal fuse used as the overheating preventer does not resume the energization to the heat source unless the overheating preventer is replaced. Therefore, the operation of the overheating preventer stops the operation of the apparatus for a while.

In the first aspect, the overheating preventer is in contact with the thermal equalization plate as the thermal equalizer. The thermal equalization plate as the thermal equalizer transfers heat to a portion having a low temperature to uniform the temperature distribution in the thermal equalization plate. The above-described function that uniforms the temperature distribution does not increase the temperature of the thermal equalization plate to the operation temperature of the overheating preventer even when the temperature of the heat source instantaneously rises to the operating temperature of the overheating preventer. As a result, the above-described structure can prevent the overheating preventer from operating despite under the normal heating control of the heat source.

In addition, the heater according to the first aspect includes the first thermal equalization plate and the second thermal equalization plate having one end in contact with the overheating preventer and the one end being spaced apart from the first equalization plate. The first thermal equalization plate is in contact with the portion of the heat source being farther from the center of the rotator than the one end of the second thermal equalization plate in the axial direction of the rotator. The above-described structure solves the issue that the overheating preventer in contact with the thermal equalization plate operates and shuts off the current flowing to the heat source although the heating control of the heat source is normally performed when the small sheets continuously pass through the fixing device.

When the temperature detector is at the center of the thermal equalization plate in the axial direction, the overheating preventer is at the position separated from the center in the axial direction. When the small sheets continuously pass through the fixing device, the temperature of the non-sheet passing region of the rotator such as the fixing belt in the axial direction becomes high because the small sheets take heat from the sheet passing region of the rotator through which the small sheets pass but do not take heat from the non-sheet passing region of the rotator outside the sheet passing region in the axial direction. When the temperature of the non-sheet passing region of the rotator becomes high, the heat of the non-sheet passing region of the rotator transfers to the thermal equalization plate as the thermal equalizer and transfers toward the center of the thermal equalization plate in the axial direction to rise the temperature at the contact portion between the thermal equalization plate and the overheating preventer. As a result, the above-described issue occurs. That is, the temperature at the contact portion between the thermal equalization plate and the overheating preventer becomes equal to or higher than the operating temperature of the overheating preventer, and the overheating preventer operates to cut off the power supply to the heat source although the heat source is normally controlled.

In the first aspect, separating the thermal equalization plate at the position outside form the contact portion between the thermal equalization plate and the overheating preventer in the axial direction prevents heat from transferring the portion of the equalization plate outside from the contact portion between the thermal equalization plate and the overheating preventer to the contact portion. In other words, since the fixing device according to the first aspect includes the second thermal equalization plate having the one end in contact with the overheating preventer and the first thermal equalization plate in contact with one end of the heat source farther from the center of the rotator than the one end of the second thermal equalization plate in the axial direction of the rotator, the heat in the non-sheet passing region transfers to the first thermal equalization plate but does not transfer to the second thermal equalization plate having the contact portion between the second thermal equalization plate and the overheating preventer. Therefore, the above-described structure can prevent the temperature of the contact portion from rising to the operation temperature of the overheating preventer when the small sheets continuously pass through the fixing device. As a result, the above-described structure can prevent the overheating preventer from operating despite under the normal heating control of the heat source when the small sheets continuously pass through the fixing device.

Second Aspect

In a second aspect, the first thermal equalization plate in the fixing device according to the first aspect is spaced apart from the one end of the second thermal equalization plate at a position adjacent to the contact portion between the overheating preventer and the second thermal equalization plate.

As described in the embodiment, the fixing device according to the second aspect can prevent heat from transferring from the outside of the contact portion between the second thermal equalization plate and the overheating preventer to the contact portion in the axial direction and satisfactorily prevent the temperature rise in the contact portion between the overheating preventer and the second thermal equalization plate.

Third Aspect

In a third aspect, the fixing device according to the first aspect or the second aspect further includes a plurality of heat sources such as the resistive heat generators 55*a* to 55*f* arranged in the axial direction.

According to the third aspect, the controller can control each of the plurality of the heat sources as described in the first variation. The controller can control the heat sources corresponding to the sheet passing region so that the temperature of the sheet passing region of the rotator such as the fixing belt 38 becomes the fixing temperature and the heat sources corresponding to the non-sheet passing region so that the temperature of the non-sheet passing region of the rotator becomes lower than the fixing temperature. The above-described control can reduce the temperature rise in the non-sheet passing region and satisfactorily prevent the temperature of the contact portion between the overheating preventer and the thermal equalization plate from rising to the operation temperature of the overheating preventer or higher. As a result, the above-described control can satisfactorily prevent the operation of the overheating preventer 35 despite under the normal heating control.

Fourth Aspect

In a fourth aspect, each of the first thermal equalization plate such as the first thermal equalization plate 57*a* and the third thermal equalization plate 57*c* and the second thermal equalization plate such as the second thermal equalization plate 57*a* in the fixing device according to the third aspect is in contact with at least two of the plurality of heat sources.

According to the fourth aspect, each of the first thermal equalization plate and the second thermal equalization plate can transfer heat between the heat sources to uniform the heat generation distribution in the heat sources as described in the first variation.

Fifth Aspect

In a fifth aspect, the fixing device according to the fourth aspect further includes a plurality of overheating preventers such as the overheating preventers 35*a* to 35*d* in FIG. 7 corresponding to the plurality of heat sources such as the resistive heat generators 55*a* to 55*d*, respectively. Each of the first thermal equalization plate such as the first or third thermal equalization plate 57*a* or 57*c* and the second thermal equalization plate such as the second thermal equalization plate 57*b* is in contact with one of the plurality of overheating preventers. The plurality of heat sources includes a first heat source corresponding to the at least one of the plurality of overheating preventers and a second heat source adjacent to the first heat source and nearer to the center of the rotator than the first heat source, and at least one of the first thermal equalization plate and the second thermal equalization plate is in contact with the first heat source and the second heat source. For example, in FIG. 7, the first thermal equalization plate 57*a* as the first thermal equalization plate is in contact with the first resistive heat generator 55*a* as the first heat source corresponding to the first overheating preventer 35*a* and the second resistive heat generator 55*b* as the second heat source adjacent to the first resistive heat generator 55*a* as the first heat source and nearer to the center of the fixing belt as the rotator than the first resistive heat generator 55*a* as the first heat source. Similarly, in FIG. 7, the third thermal equalization plate 57*c* as the first thermal equalization plate is in contact with the fourth resistive heat generator 55*d* as the first heat source corresponding to the fourth overheating preventer 35*d* and the third resistive heat generator 55*c* as the second heat source adjacent to the fourth resistive heat generator 55*d* as the first heat source and nearer to the center of the fixing belt as the rotator than the fourth resistive heat generator 55*d* as the first heat source. The first thermal equalization plate 57*a* and the fifth thermal equalization plate 57*e* in FIG. 8 are also configured similarly as the first thermal equalization plates. In FIG. 8, the second thermal equalization plate 57*b* as the second thermal equalization plate is in contact with the second resistive heat generator 55*b* as the first heat source corresponding to the second overheating preventer 35*b* and the third resistive heat generator 55*c* as the second heat source adjacent to the second resistive heat generator 55*b* as the first heat source and nearer to the center of the fixing belt as the rotator than the second resistive heat generator 55*b* as the first heat source. Similarly, in FIG. 8, the fourth thermal equalization plate 57*d* as the second thermal equalization plate is in contact with the fifth resistive heat generator 55*e* as the first heat source corresponding to the fifth overheating preventer 35*e* and the fourth resistive heat generator 55*d* as the second heat source adjacent to the fifth resistive heat generator 55*e* as the first heat source and nearer to the center of the fixing belt as the rotator than the fifth resistive heat generator 55*e* as the first heat source.

According to the fifth aspect, the controller controls the first heat source and the second heat source so as to set the heat generation amount generated by the first heat source smaller than the heat generation amount generated by the second heat source inside from the first heat source in the axial direction and set a temperature at a portion of the rotator such as the fixing belt facing the outer end of the thermal equalization plate in contact with the second heat source when the sheet having one end opposite the outer end of the thermal equalization plate in contact with the second heat source pass through the fixing device as described in the first variation. The above-described configuration can prevent the occurrence of a fixing failure and the temperature rise in the non-sheet passing region. Preventing the temperature rise in the non-sheet passing region can satisfactorily prevent the temperature at the contact portion between the thermal equalization plate and the overheating preventer from reaching to the operation temperature of the overheating preventer or higher. Accordingly, the above-described configuration can prevent the overheating preventer from operating despite under the normal heating control of the heat source corresponding to the overheating preventer.

Sixth Aspect

In a sixth aspect, the edge of the one end of the second thermal equalization plate in the fixing device according to the fifth aspect is on an inner portion of the first heat source between a center of the first heat source in the axial direction and an inner end of the first heat source closer to the center of the rotator in the axial direction. For example, the left edge of the second thermal equalization plate 57*b* in FIG. 9 as the edge of the one end of the second thermal equalization plate is on an inner portion of the second resistive heat generator 55*b* as the first heater between the center of the resistive heat generator 55*b* in the axial direction and an inner end of the resistive heat generator 55*b* closer to the center of the rotator in the axial direction that is the right end of the resistive heat generator 55*b* and the end nearer to the center of the fixing belt as the rotator than an outer end of the resistive heat generator 55*b*. Similarly, the right edge of the fourth thermal equalization plate 57*d* in FIG. 9 as the edge of the one end of the second thermal equalization plate is on an inner portion of the fifth resistive heat generator 55*e* as the first heater between the center of the resistive heat generator 55*e* in the axial direction to an inner end of the resistive heat generator 55*e* closer to the center of the rotator in the axial direction that is the left end of the resistive heat generator 55*e*.

According to the sixth aspect, even if the heat generation amount generated by the first heat source when the edge of the one end of the second thermal equalization plate is on the inner portion of the first heat source between the center of the first heat source to the inner end of the first heat source is set to be smaller than the heat generation amount generated by the first heat source when the edge of the one end of the second thermal equalization plate is on an outer portion of the first heat source between the center of the first heat source in the axial direction and an outer end of the first heat source, a temperature at the edge of the one end of the second thermal equalization plate can reach to the fixing temperature as described in the second variation. The above-described configuration can prevent the occurrence of the fixing failure and the temperature rise in the non-sheet passing region when the sheets having one end opposite the one end of the second thermal equalization plate pass through the fixing device.

Seventh Aspect

In a seventh aspect, the fixing device according to any one of the third aspect to the sixth aspect further includes a plurality of overheating preventers such as the overheating preventers 35*a* to 3M in FIG. 9 corresponding to the plurality of heat sources such as the resistive heat generators 55*a* to 55*f* in FIG. 9, respectively. At least one of the plurality of overheating preventers corresponding to the heat sources other than the heat sources at both ends in the axial direction faces an inner portion of the corresponding heat source between a center of the corresponding heat source in the axial direction and an inner end of the corresponding heat source proximal to the center of the rotator in the axial direction. For example, in FIG. 9, the resistive heat generators 55*b* to 55*e* other than the resistive heat generators 55*a* and 55*f* at both ends in the axial direction correspond to the overheating preventers 35*b* to 35*e*, respectively. The overheating preventer 35*b* faces an inner portion of the corresponding resistive heat generator 55*b* between the center of the resistive heat generator 55*b* in the axial direction of the fixing belt and the inner end of the resistive heat generator 55*b* proximal to the center of the fixing belt as the rotator in the axial direction. Similarly, the overheating preventers 35*c* to 35*e* face inner portions of the corresponding heat generators 55*c* to 55*e*, respectively.

The above-described configuration according to the seventh aspect is less affected by the heat in the non-sheet passing region than a configuration including the overheating preventer facing an outer portion of the corresponding heat source outside from the inner portion of the heat source in the axial direction. As a result, the above-described structure can prevent the overheating preventer from operating and cutting off the power supply to the corresponding heat source despite under the normal heating control of the corresponding heat source.

Eighth Aspect

In an eighth aspect, the fixing device according to any one of the third aspect to the seventh aspect further includes a plurality of overheating preventers such as the overheating preventers 35*a* to 3M in FIG. 9 corresponding to the plurality of heat sources such as the resistive heat generators 55*a* to 55*f*, respectively. At least one of the plurality of overheating preventers corresponding to the heat sources at both ends in the axial direction faces an outer end of the corresponding heat source distal to the center of the rotator in the axial direction. For example, the overheating preventer 35*a* faces an outer end of the resistive heat generator 55*a*, and the overheating preventer 35*f* faces an outer end of the resistive heat generator 55*f* in FIG. 9.

According to the eighth aspect, the overheating preventer is in contact with a portion of the thermal equalizer such as the thermal equalization plate in which the temperature rise is small. Accordingly, the above-described structure can prevent the overheating preventer from operating and cutting off the power supply to the corresponding heat source at an end despite under the normal heating control of the corresponding heat source at the end.

Ninth Aspect

In a ninth aspect, an image forming apparatus includes an image forming section configured to form an image on a recording medium and the fixing device such as the fixing device 12 according to any one of the first aspect to the eighth aspect configured to fix the image onto the recording medium.

The above structure according to the ninth aspect can prevent the image forming apparatus from abnormally stopping under a normal state.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A fixing device comprising:

a rotator;

a heat source configured to heat the rotator;

a first thermal equalization plate in contact with the heat source;

a second thermal equalization plate in contact with the heat source;

a temperature detector in contact with the second thermal equalization plate at a center thereof in an axial direction of the rotator and not in contact with the first thermal equalization plate, the temperature detector connected to a controller that controls the heat source;

an overheating preventer in contact with the second thermal equalization plate at a position offset towards one end thereof in the axial direction of the rotator; and the first thermal equalization plate in contact with a portion of the heat source, the portion of the heat source being farther from a center of the rotator than the one end of the second thermal equalization plate in the axial direction of the rotator, the first thermal equalization plate being spaced apart from the one end of the second thermal equalization plate.

2. The fixing device according to claim 1, wherein the first thermal equalization plate is spaced apart from the one end of the second thermal equalization plate at a position adjacent to a contact portion between the overheating preventer and the second thermal equalization plate.

3. The fixing device according to claim 1, further comprising a plurality of heat sources including the heat source and being arranged in the axial direction.

4. The fixing device according to claim 3, wherein each of the first thermal equalization plate and the second thermal equalization plate is in contact with at least two of the plurality of heat sources.

5. The fixing device according to claim 4, further comprising a plurality of overheating preventers including the overheating preventer and corresponding to the plurality of heat sources, respectively, wherein each of the first thermal equalization plate and the second thermal equalization plate is in contact with one of the plurality of overheating preventers, wherein the plurality of heat sources includes a first heat source corresponding to the one of the plurality of overheating preventers and a second heat source adjacent to the first heat source and nearer to the center of the rotator than the first heat source, and wherein at least one of the first thermal equalization plate and the second thermal equalization plate is in contact with the first heat source and the second heat source.

6. The fixing device according to claim 5, wherein an edge of the one end of the second thermal equalization plate is on an inner portion of the first heat source between a center of the first heat source in the axial direction and an inner end of the first heat source closer to the center of the rotator in the axial direction.

7. The fixing device according to claim 3, further comprising:

a plurality of overheating preventers including the overheating preventer and corresponding to the plurality of heat sources, respectively, wherein the plurality of heat sources includes a pair of end heat sources distal to the center of the rotator in the axial direction and center heat sources between the pair of end heat sources in the axial direction, end ones of the plurality of overheating preventers in the axial direction are aligned with corresponding ends of respective ones of the end heat sources, and center ones of the plurality of overheating preventers between the end ones of the plurality of overheating preventers are offset from corresponding ends of respective ones of the center heat sources.

8. The fixing device according to claim 3, further comprising:

a plurality of overheating preventers including the overheating preventer and corresponding to the plurality of heat sources, respectively, wherein the plurality of heat sources includes a pair of end heat sources distal to the center of the rotator in the axial direction and center heat sources between the pair of end heat sources in the axial direction, wherein at least one of the plurality of overheating preventers corresponding to the end heat sources is aligned with an outer end of a corresponding one of the end heat sources.

9. An image forming apparatus comprising:

an image forming section configured to form an image on a recording medium; and the fixing device according to claim 1 configured to fix the image onto the recording medium.

10. The fixing device according to claim 1, further comprising:

a plurality of overheating preventers including the overheating preventer, wherein the first thermal equalization plate that is not in contact with the temperature detector is in contact with only one of the plurality of overheating preventers, and the second thermal equalization plate having the temperature detector in contact therewith is in contact with at least two of the plurality overheating preventers.

11. The fixing device according to claim 1, further comprising:

a plurality of heat sources including the heat source and being arranged in the axial direction, a plurality of overheating preventers including the overheating preventer and corresponding to the plurality of heat sources, respectively, wherein the first thermal equalization plate and the second thermal equalization plate are each in contact with at least two of the plurality of heat sources.

* * * * *